US005433290A

United States Patent [19]

Ellis et al.

[11] Patent Number: 5,433,290

[45] Date of Patent: Jul. 18, 1995

[54] SAFETY LINE SHOCK ABSORBER

[75] Inventors: J. N. Ellis, Wilmington, Del.; Ravi S. Sastry, King of Prussia, Pa.

[73] Assignee: Research & Trading Corporation, Wilmington, Del.

[21] Appl. No.: 307,098

[22] Filed: Sep. 16, 1994

Related U.S. Application Data

[63] Continuation-in-part of Ser. No. 130,992, Oct. 4, 1993, abandoned.

[51] Int. Cl.[6] ..... A62B 35/00

[52] U.S. Cl. ..... 182/3; 188/371

[58] Field of Search ..... 182/3, 18; 188/371, 188/376; 280/805

[56] References Cited

U.S. PATENT DOCUMENTS

| | | |
|---|---|---|
| 2,303,954 | 12/1942 | Roke . |
| 2,474,124 | 6/1949 | Schultz . |
| 3,449,957 | 5/1969 | Ervin, Jr. . |
| 3,504,460 | 4/1970 | Solberg . |
| 3,550,957 | 12/1970 | Radke et al. . |
| 3,843,193 | 10/1974 | Krings et al. . |
| 3,937,407 | 2/1976 | Matsuo . |
| 3,997,190 | 12/1976 | Seiffert et al. . |
| 4,060,278 | 11/1977 | Maeyerspeer . |
| 4,100,996 | 7/1978 | Sharp . |
| 4,194,411 | 3/1980 | Manabe et al. . |
| 4,446,944 | 5/1984 | Forrest et al. . |
| 4,515,254 | 5/1985 | Markow et al. . |
| 4,538,702 | 9/1985 | Wolner . |
| 4,588,208 | 5/1986 | Yoshitsugu . |
| 4,618,026 | 10/1986 | Olson . |
| 4,753,772 | 6/1988 | Schmertz . |
| 5,048,863 | 9/1991 | Henseler et al. . |
| 5,113,981 | 5/1992 | Lantz . |
| 5,143,187 | 9/1992 | McQuarrie et al. . |
| 5,174,410 | 12/1992 | Casebolt . |

FOREIGN PATENT DOCUMENTS

| | | | |
|---|---|---|---|
| 76235 | 6/1980 | Japan | 188/371 |

*Primary Examiner*—Alvin C. Chin-Shue

*Attorney, Agent, or Firm*—Breneman, Georges & Krikelis

[57] ABSTRACT

A shock absorber for fall protection systems is described. It is comprised of elongated first and second side by side inelastic elements having proximal and distal ends; means for attaching the distal end of said first inelastic element to the proximal end of said second inelastic element; a plurality of paired opposing first and second openings extending along the length of said first and second inelastic elements; and, a plurality of energy absorbing cables, extending, respectively, through said plurality of opposing pairs of openings, said energy absorbing cables having at each end thereof means to prevent withdrawal of said energy absorbing cables through the openings and said energy absorbing cables being of progressively longer lengths, whereby application of above normal shock loads on said shock absorer will cause the energy absorbing cables to break in sequence beginning with the shortest length shock absorbing cable.

17 Claims, 3 Drawing Sheets

SAFETY LINE SHOCK ABSORBER

This application is a continuation in part of application Ser. No. 08/130,992 filed Oct. 4, 1993, now abandoned.

FIELD OF THE INVENTION

The present invention relates to shock absorbers for dissipating the kinetic energy of a falling object. More specifically, the invention relates to devices desired to slow and stop the fall of a workman positioned on a scaffold, catwalk, or other high place where the fall could result in serious injury.

BACKGROUND OF THE INVENTION

A variety of shock absorbers utilized for fall protection are described in the prior art. Representative patents are the following: U.S. Pat. Nos. 2,303,954; 2,474,124; 3,444,957; 3,504,460; 3,550,957; 3,804,698; 3,937,407; 3,997,190; 4,100,996; 4,194,411; 4,446,944; 4,515,254; 4,538,702; 4,588,208; 4,618,026; 5,048,863; 5,113,981; 5,143,187; and 5,174,410.

One category of shock absorbers utilizes a folded over belt, band, webbing, chain or the like, wherein a plurality of energy absorbing components secure the fold and essentially unravel or break as the belt, band, webbing or chain unfolds. Among the energy absorbing components are stitches (U.S. Pat. No. 3,550,957), interknitted loops (U.S. Pat. No. 4,515,214) and metal cable affixed to a folded over (U-shaped) chain (U.S. Pat. No. 5,143,187).

The present invention offers yet another architecture for shock absorbers which utilizes a pair of side-by-side metal bars connected at opposing ends. There are openings along the bar lengths of the shock absorber of the present invention through which cables of successively longer lengths are secured, suitably by swaging. The successively longer cables break in sequence when an abnormal load is applied. The sequence begins with the shortest length cable. The force applied to the shock absorber is sequentially absorbed.

SUMMARY OF THE INVENTION

The invention provides an apparatus for use as a shock absorber in fall protection systems. The shock absorber for fall protection systems of the present invention comprises elongated first and second side-by-side inelastic elements having proximal and distal ends. Such elements may suitably be metal bars. The distal end of the first inelastic element is affixed to the proximal end of the second inelastic element. The inelastic elements are attached together by chain, cable, or other means of affixation. A plurality of paired opposing first and second openings extends along the length of the elongated first and second inelastic elements. Energy absorbing cables extend through opposing pairs of openings. The energy absorbing cables, at each end thereof, include means to prevent withdrawal through the openings. The energy absorbing cables that pass, respectively, through each of the paired opposing openings, are of progressively greater lengths. Upon application of above normal shock loads on the shock absorber, the energy absorbing cables break in sequence, beginning with the shortest length shock absorbing cable and ending with the longest shock absorbing cable. The energy absorbing cables preferably are wire cables swaged at either end.

The shock absorber preferably is enclosed in a cover. Most preferably, a cover of water impermeable polymer material.

The distal end of the first inelastic element is preferably attached to the proximal end of said second inelastic element with a metal chain.

The proximal end of the first elongated inelastic element and the distal end of the second inelastic element may suitably have openings therein by which the shock absorber can be engaged. One of the openings can be used for anchoring the device, e.g., by links, eyebolts, spliced loops, etc. and the other opening can be used for connection to a safety belt ring or other suitable harness or safety belt engaging means.

DETAILED DESCRIPTION OF THE DRAWINGS

Figure 1:
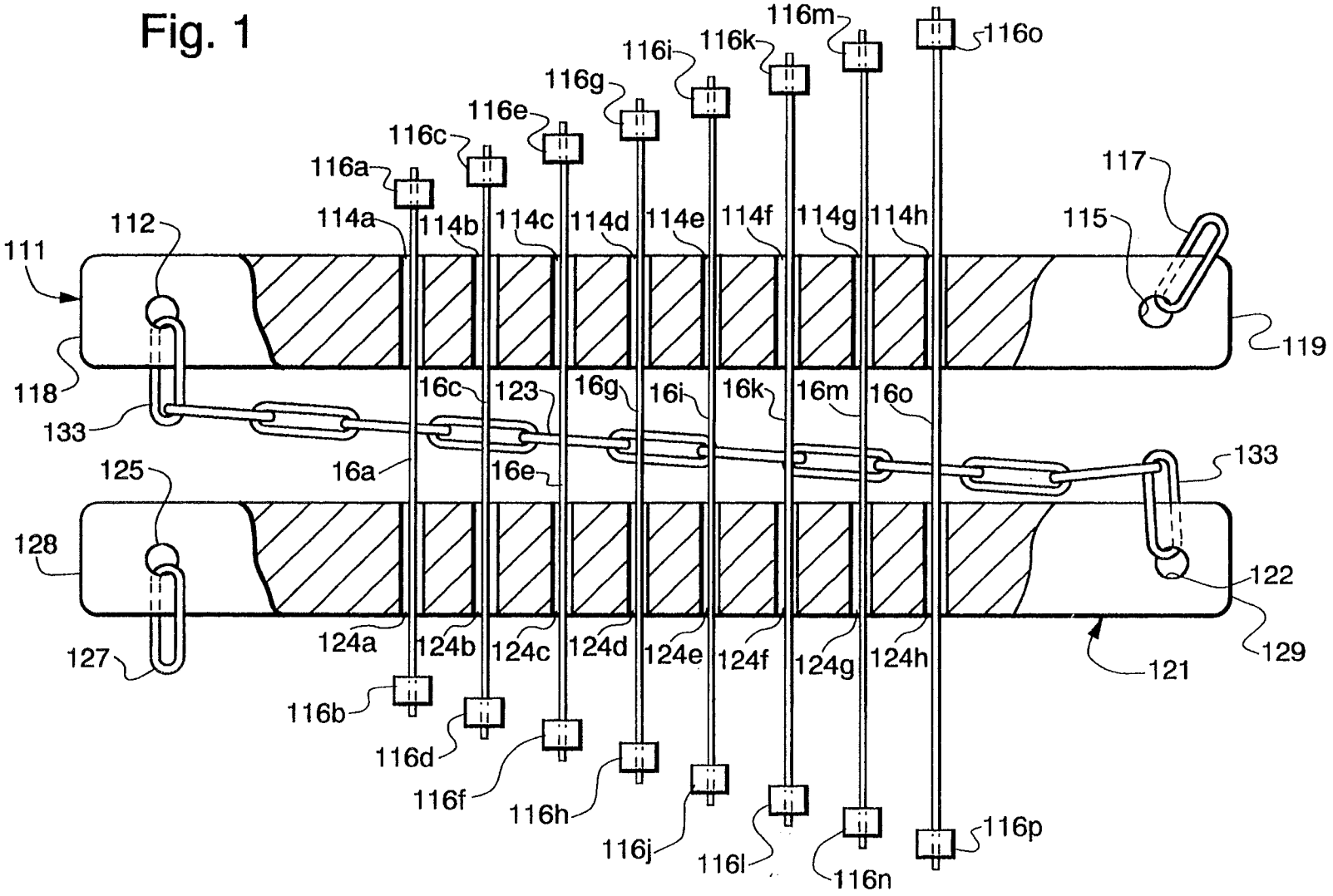
FIG. 1 is a cross-section of a schematic representation of the side view of the shock absorber according to the invention prior to use.

In FIG. 1 the shock absorber of the present invention is shown. In the illustrated embodiment, the inelastic elements 111 and 121 are stainless steel bars about two inches in width and $\frac{1}{4}$ inch in thickness with a length of about $16\frac{1}{2}$ inches.

Inelastic elements 111 and 121 are connected by chain 123, suitably a galvanized or stainless steel chain, having shackles 133 at either end. One end of chain 123 is affixed to opening 112 at the proximal end 118 of the second inelastic element 111 and the other end is affixed to the distal end 129 of inelastic element 121. Affixation is achieved using shackles 133.

In the illustrated embodiment of the invention of FIG. 1, eight paired openings, 114(*a*) and 124(*a*); 114(*b*) and 124(*b*); 114(*c*) and 124(*c*); 114(*d*) and 124(*d*); 114(*e*) and 124(*e*); 114(*f*) and 124(*f*); 114(*g*) and 124(*g*); and, 114(*h*) and 124(*h*) are illustrated. They are arranged to accommodate a 3/16 inch cable and are suitably about 15/64 inches in diameter. The spacing between adjacent openings measured center to center for openings 114(*a*)–114(*h*), inclusive, is about 1 inch. That is, the holes are spaced apart along the lengths of the inelastic elements 111 and 121 in one inch increments.

Eight energy absorbing cables made of 3/16 inch stainless steel 7×19 aircraft cable extend through the paired openings of inelastic elements 111 and 121.

The length of cable 16(*a*) between swages 116(*a*) and 116(*b*) is about 3 inches. The length of cable 16(*c*) between swages 116(*c*) and 116(*d*) is 4 inches. The length of cable 16(*e*) between swages 116(*e*) and 116(*f*) is about 5 inches. The length of cable 16(*g*) between swages 116(*g*) and 116(*h*) is about 6 inches. The length of cable 16(*i*) between swages 116(*i*) and 116(*j*) is about 7 inches. The length of cable 16(*k*) between swages 116(*k*) and 116(*l*) is about 8 inches. The length of cable 16(*m*), between swages 116(*m*) and 116(*n*) is about 9 inches. The length of cable 16(*o*) and 16(*p*) is about 10 inches. The swages 116(*a*) through 116(*r*), inclusive, are 3/16 inch aluminum oval swages.

Proximate to the proximal end 128 of the first inelastic element 121, opening 125, which is about $\frac{7}{8}$ inch in diameter, is provided through which a shackle of $\frac{3}{4}$ inch diameter is passed to facilitate attachment to a worker's safety line or anchor means. Proximate the distal end 119 of second inelastic element 111, a $\frac{7}{8}$ inch opening 115 is provided through which a shackle 117, missing link, or the like is passed to facilitate attachment. When shackle 117 is associated with the object, the fall of which is to be cushioned, then shackle 127 is the anchor and vice versa. In the schematically illustrated embodiment of the invention, the distance between the center of holes 112 and 114(*a*) is 3 inches and the distance between the centers of holes 115 and 114(*q*) is 3.5 inches.

When the shock absorber is assembled and in use, the side-by-side inelastic elements are displaced with the proximal end 128 extending beyond proximal end 118 and distal end 119 extending beyond distal end 129.

Figure 2:
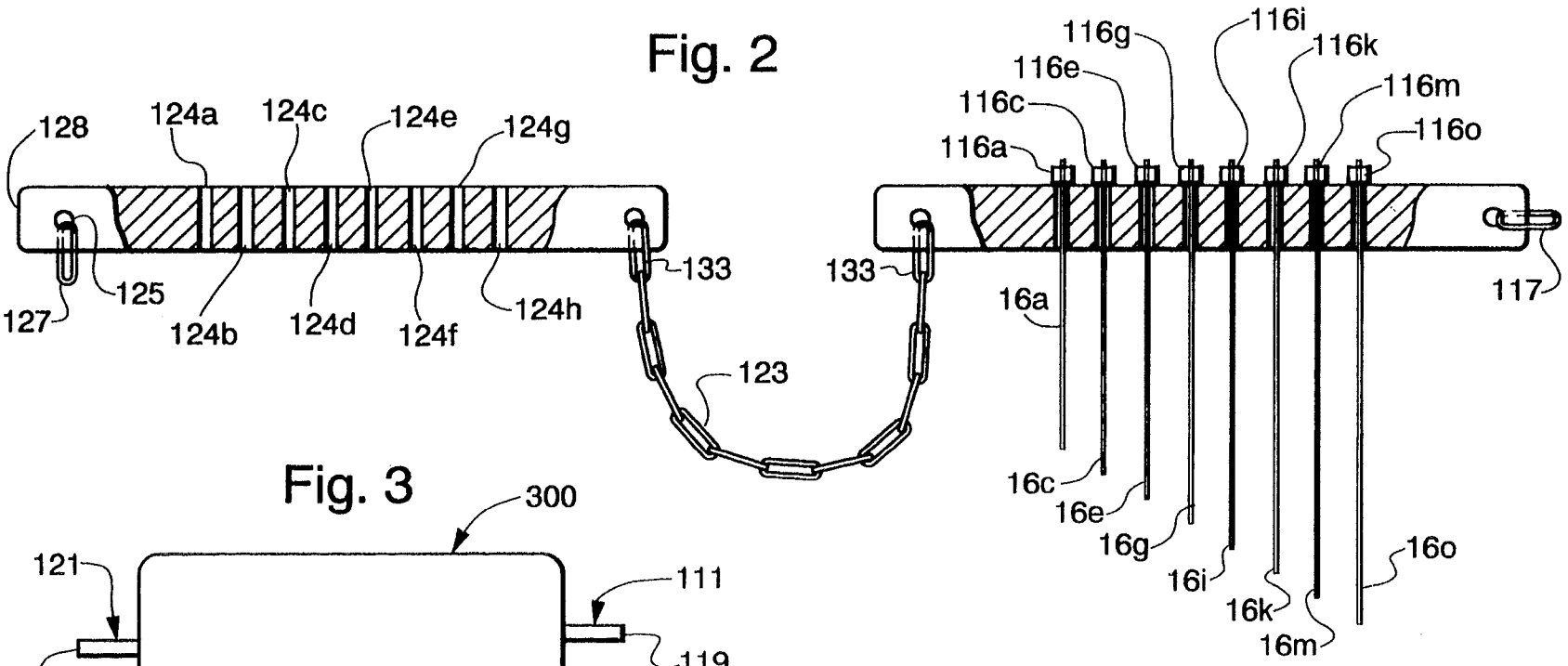
FIG. 2 is a cross-section of a schematic representation of the side view of the shock absorber after use, with shock absorbing capacity exhausted and all energy absorbing cables broken.

FIG. 2 illustrates the exhausted device in which the applied force has broken all the shock absorbing cables and the inelastic elements 121 and 111 have been pulled apart with interlinking chain 123 extended and still securing elements 121 and 111 together. The chain 123 is suitably galvanized or stainless steel and is connected to the two inelastic elements 121 and 111 using a shackle, missing link or the like. The chain length is about 16 inches and link strength is about 10,000 pounds.

Where opening 115 is used for attachment to a worker to be protected from a fall, shackling or direct attachment by turnbuckle are typically used for affixation to a body engaging apparatus such as a safety belt, harness or the like.

Figure 3:
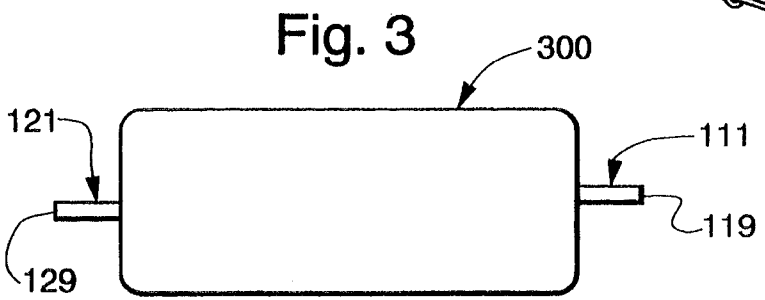
FIG. 3 is a schematic representation of the side plan view of the covered shock absorber.
Figure 4:
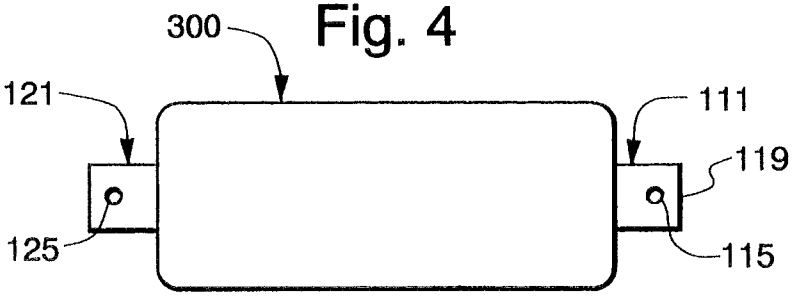
FIG. 4 is a schematic representation of a top plan view of the covered shock absorber.

In FIGS. 3 and 4, the shock absorber is shown schematically with a cover 300 which preferably is water resistant polymer in the form of a tube or pipe covering same. The opening 125, proximate the proximal end 128 of inelastic element 121, extends out from the cover. The opening 115, proximate the distal end 119 of inelastic element 111, also extends out from the cover.

Figure 5:
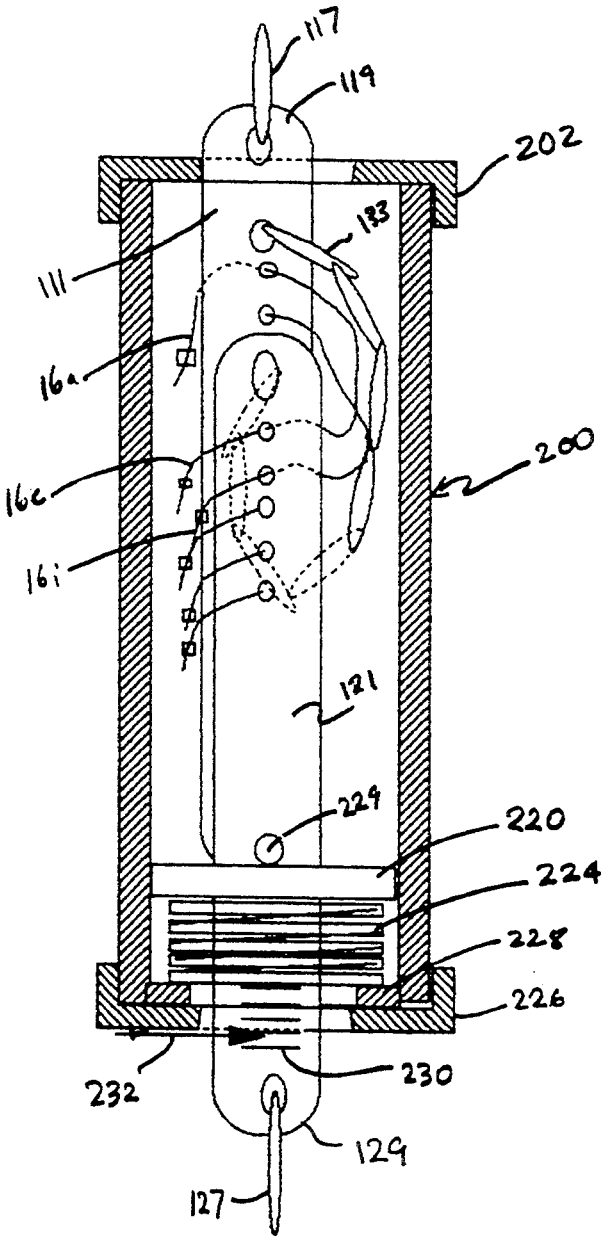
FIG. 5 is a schematic representation of an alternate embodiment of the shock absorber which includes a tension indicator.

FIG. 5 shows an alternate embodiment of the shock absorber of this invention, which incorporates a tension indicator integral with the Shock absorber cover, which tension indicator is useful in showing the tension applied to the safety system at any one time. The indicator includes a cover which is preferably a cylindrical casing 200. A compression spring 224 is located at one end of casing 200. The casing 200 has a closed end 226 with an opening through which extends the inelastic element 121. Spring supports 228, adjacent end 226 within casing 200 form a shoulder for supporting one end of spring 224. A backing plate 220 through which extends the inelastic element 121 prevents the abutment 220 from traveling past a selected point. Thus the length of the end portion 129 of the inelastic element 121 that extends outside casing 200 depends on the amount of pressure applied to the compression spring, which is related to the tension applied between end 119 of inelastic element 111 and end 129 of inelastic element 121. Inelastic element 121 preferably includes indicia 230 along the portion of its length that extends outside the casing, which co-operate with a stationary pointer 232 to provide an indicator of the tension applied to the shock absorber at any time. A removable cap 202 closes the other end of casing 200. End 119 of inelastic element 111 extends through cap 202.

If desired, two springs may be used, one at each end of the casing.

In effect, the present invention relates to the use of a system which replicates the operation of shock absorbing webbing. Accordingly, in the same way that a series of folded over belts or webs are used, paired inelastic elements of the present invention can be attached in series. For example, two or more of the shock absorbing units shown in FIG. 1 could be attached together to form a series of shock absorbers. Moreover, the number, breakpoint and length of the shock absorbing cables/lines, the materials used for the inelastic elements and the interconnecting chain can be selected based on the particular application intended.

While the invention has been described as a shock controller for fall protection, it obviously can be used in other environments for like purpose. Accordingly, the specific arrangement disclosed is illustrative only and not limiting regarding the scope of the invention which is defined by the appended claims and any and all equivalents thereof.

We claim:

1. A shock absorber for fall protection systems comprising:

(a) elongated first and second side-by-side inelastic elements having proximal and distal ends;

(b) means for attaching the distal end of said first inelastic element to the proximal end of said second inelastic element;

(c) a plurality of paired opposing first and second openings extending along the length of said first and second inelastic elements; and, (d) a plurality of energy absorbing cables, extending, respectively, through said plurality of opposing pairs of openings, said energy absorbing cables having at each end thereof means to prevent withdrawal of said energy absorbing cables through the openings and said energy absorbing cables being of progressively longer lengths, whereby application of above normal shock loads on said shock absorber will cause the energy absorbing cables to break in sequence beginning with the shortest length shock absorbing cable.

2. The shock absorber of claim 1, wherein the energy absorbing cable is a wire cable swaged at either end.

3. The shock absorber of claim 1, further comprising a cover of water impermeable polymer material.

4. The shock absorber of claim 2, further comprising a cover of water impermeable polymer material.

5. The shock absorber of claim 1, wherein the means of attaching the distal end of said first inelastic element to the proximal end of said second inelastic element is a metal chain.

6. The shock absorber of claim 2, wherein the means of attaching the distal end of said first inelastic element to the proximal end of said second inelastic element is a metal chain.

7. The shock absorber of claim 3, wherein the means of attaching the distal end of said first inelastic element to the proximal end of said second inelastic element is a metal chain.

8. The shock absorber of claim 4, wherein the means of attaching the distal end of said first inelastic element to the proximal end of said second inelastic element is a metal chain.

9. The shock absorber of claim 1, further comprising:

(e) attachment means at the proximal end of said first inelastic element; and, (f) attachment means at the distal end of said second inelastic element.

10. The shock absorber of claim 2, further comprising:

(e) attachment means at the proximal end of said first inelastic element; and, (f) attachment means at the distal end of said second inelastic element.

11. The shock absorber of claim 3, further comprising:

(e) attachment means at the proximal end of said first inelastic element; and, (f) attachment means at the distal end of said second inelastic element.

12. The shock absorber of claim 4, further comprising:

(e) attachment means at the proximal end of said first inelastic element; and, (f) attachment means at the distal end of said second inelastic element.

13. The shock absorber of claim 5, further comprising:

(e) attachment means at the proximal end of said first inelastic element; and, (f) attachment means at the distal end of said second inelastic element.

14. The shock absorber of claim 6, further comprising:

(e) attachment means at the proximal end of said first inelastic element; and, (f) attachment means at the distal end of said second inelastic element.

15. The shock absorber of claim 7, further comprising:

(e) attachment means at the proximal end of said first inelastic element; and, (f) attachment means at the distal end of said second inelastic element.

16. The shock absorber of claim 8, further comprising:

(e) attachment means at the proximal end of said first inelastic element; and, (f) attachment means at the distal end of said second inelastic element.

17. The shock absorber of claim 1 further comprising a tension indicator.

* * * * *